US006287186B1

(12) United States Patent
Miller, Jr. et al.

(10) Patent No.: US 6,287,186 B1
(45) Date of Patent: Sep. 11, 2001

(54) GRINDING WHEEL

(76) Inventors: Richard A. Miller, Jr., 5100 Bordman Rd., Dryden, MI (US) 48428; Jerry W. Karnes, 13925 Billette Dr., Sterling Heights, MI (US) 48313

( * ) Notice: Subject to any disclaimer, the term of this patent is extended or adjusted under 35 U.S.C. 154(b) by 0 days.

(21) Appl. No.: 09/653,304

(22) Filed: Sep. 1, 2000

(51) Int. Cl.[7] ..... B23F 21/03
(52) U.S. Cl. ..... 451/548; 451/540
(58) Field of Search ..... 451/540, 541, 451/542, 547, 548

(56) References Cited

U.S. PATENT DOCUMENTS

| | | | | |
|---|---|---|---|---|
| D. 32,220 | | 2/1900 | Davis . | |
| 3,420,010 | | 1/1969 | Tobey . | |
| 3,579,928 | | 5/1971 | Held . | |
| 3,711,999 | | 1/1973 | Held . | |
| 4,021,969 | * | 5/1977 | Davis, Jr. | 51/135 R |
| 4,940,039 | | 7/1990 | Buettner . | |
| 5,040,341 | | 8/1991 | Okinaga . | |
| 5,321,915 | | 6/1994 | Lecerf et al. . | |
| 5,787,871 | * | 8/1998 | Jones et al. | 125/15 |
| 6,077,156 | * | 6/2000 | Amin et al. | 451/548 |
| 6,159,089 | * | 12/2000 | Amin et al. | 451/548 |

* cited by examiner

*Primary Examiner*—Timothy V. Eley
*Assistant Examiner*—Dung Van Nguyen

(57) ABSTRACT

A grinding wheel for seeing the underside of the object being ground. The grinding wheel includes a grinding wheel. The grinding wheel has a peripheral edge. The grinding wheel has an axis having a hole therethrough. The peripheral edge has a plurality of slots therein extending toward a center of the grinding wheel. Each of the slots is equally spaced from each other.

4 Claims, 2 Drawing Sheets

GRINDING WHEEL

BACKGROUND OF THE INVENTION

1. Field of the Invention

The present invention relates to grinding wheels and more particularly pertains to a new grinding wheel for seeing the underside of the object being ground.

2. Description of the Prior Art

The use of grinding wheels is known in the prior art. More specifically, grinding wheels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,711,999; U.S. Pat. No. 3,420,010; U.S. Pat. No. 5,321,915; U.S. Pat. No. 5,040,341; U.S. Pat. No. 4,940,039; U.S. Pat. No. 3,579,928 and U.S. Des. Pat. No. 32,226.

While these devices fulfill their respective, particular objectives and requirements, the aforementioned patents do not disclose a new grinding wheel. The inventive device includes a grinding wheel. The grinding wheel has a peripheral edge. The grinding wheel has a center having a hole therethrough. The peripheral edge has a plurality of slots therein extending toward and axis of the grinding wheel. Each of the slots is equally spaced from each other.

In these respects, the grinding wheel according to the present invention substantially departs from the conventional concepts and designs of the prior art , and in so doing provides an apparatus primarily developed for the purpose of seeing the underside of the object being round.

SUMMARY OF THE INVENTION

In view of the foregoing disadvantages inherent in the known types of grinding wheels now present in the prior art, the present invention provides a new grinding wheel construction wherein the same can be utilized for seeing the underside of the object being ground.

The general purpose of the present invention, which will be described subsequently in greater detail, is to provide a new grinding wheel apparatus and method which has many of the advantages of the grinding wheels mentioned heretofore and many novel features that result in a new grinding wheel which is not anticipated, rendered obvious, suggested, or even implied by any of the prior art grinding wheels, either alone or in any combination thereof.

To attain this, the present invention generally comprises a grinding wheel. The grinding wheel has a peripheral edge. The grinding wheel has a center having a hole therethrough. The peripheral edge has a plurality of slots therein extending toward and axis of the grinding wheel. Each of the slots is equally spaced from each other.

There has thus been outlined, rather broadly, the more important features of the invention in order that the detailed description thereof that follows may be better understood. and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing, of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grinding wheel apparatus and method which has many of the advantages of the grinding wheels mentioned heretofore and many novel features that result in a new grinding wheel which is not anticipated, rendered obvious, suggested, or even implied by any of the prior art grinding wheels, either alone or in any combination thereof.

It is another object of the present invention to provide a new grinding wheel which may be easily and efficiently manufactured and marketed.

It is a further object of the present invention to provide a new grinding wheel which is of a durable and reliable construction.

An even further object of the present invention is to provide a new grinding wheel which is susceptible of a low cost of manufacture with regard to both materials and labor, and which accordingly is then susceptible of low prices of sale to the consuming public, thereby making such grinding wheel economically available to the buying public.

Still yet another object of the present invention is to provide a new grinding wheel which provides in the apparatuses and methods of the prior art some of the advantages thereof, while simultaneously overcoming some of the disadvantages normally associated therewith.

Still another object of the present invention is to provide a new grinding wheel for seeing the underside of the object being ground.

Yet another object of the present invention is to provide a new grinding wheel which includes a grinding wheel. The grinding wheel has a peripheral edge. The grinding wheel has an axis having a hole therethrough. The peripheral edge has a plurality of slots therein extending toward a center of the grinding wheel. Each of the slots is equally spaced from each other.

Still yet another object of the present invention is to provide a new grinding wheel that is retrofittable to existing grinding machines.

Even still another object of the present invention is to provide a new grinding wheel that has slots therein allowing the user to see the area being ground when the grinding wheel is rotated at a high velocity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
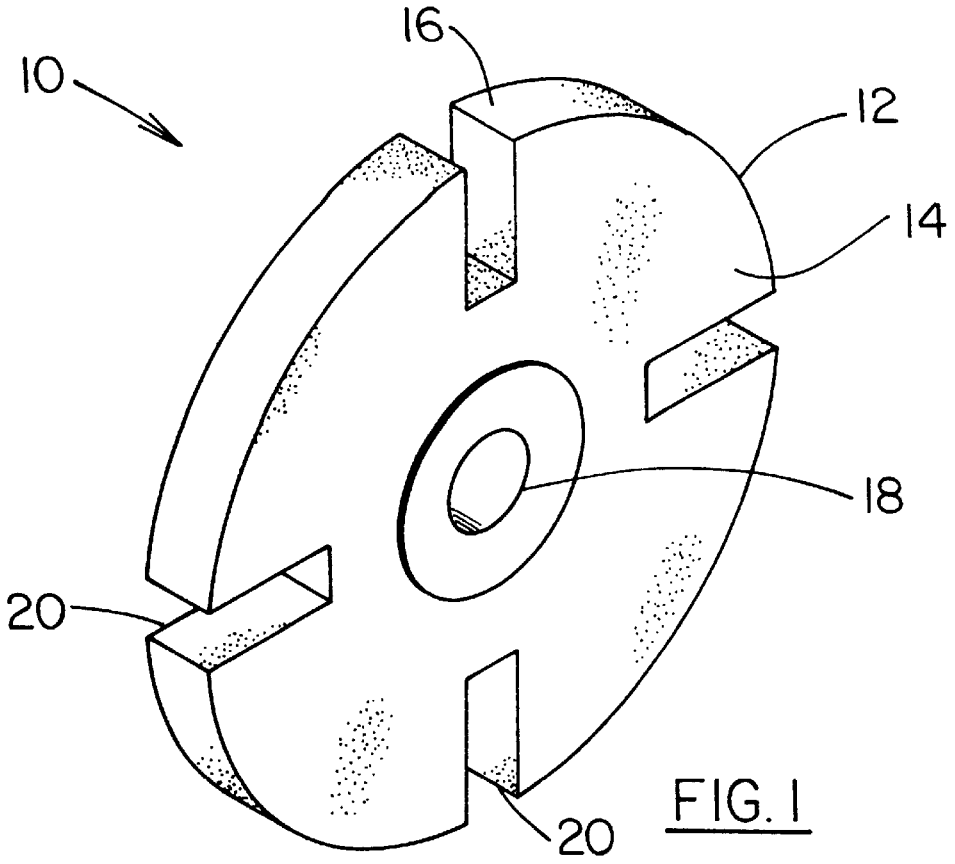
FIG. 1 is a schematic perspective view of a new grinding wheel according to the present invention.
Figure 2:
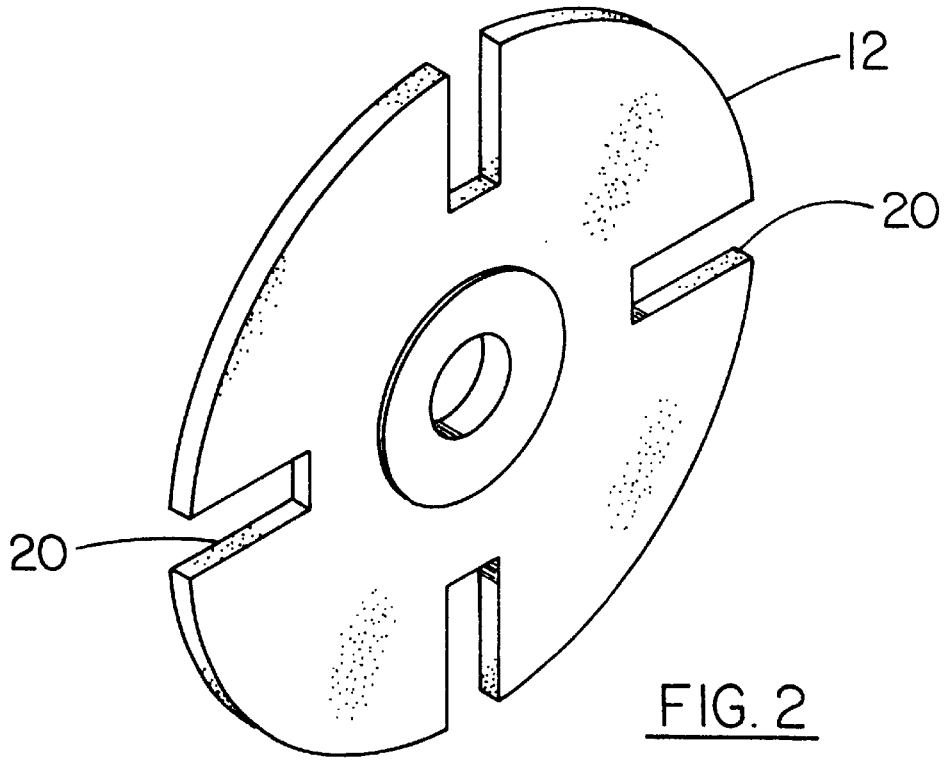
FIG. 2 is a schematic perspective view of the present invention.
Figure 3:
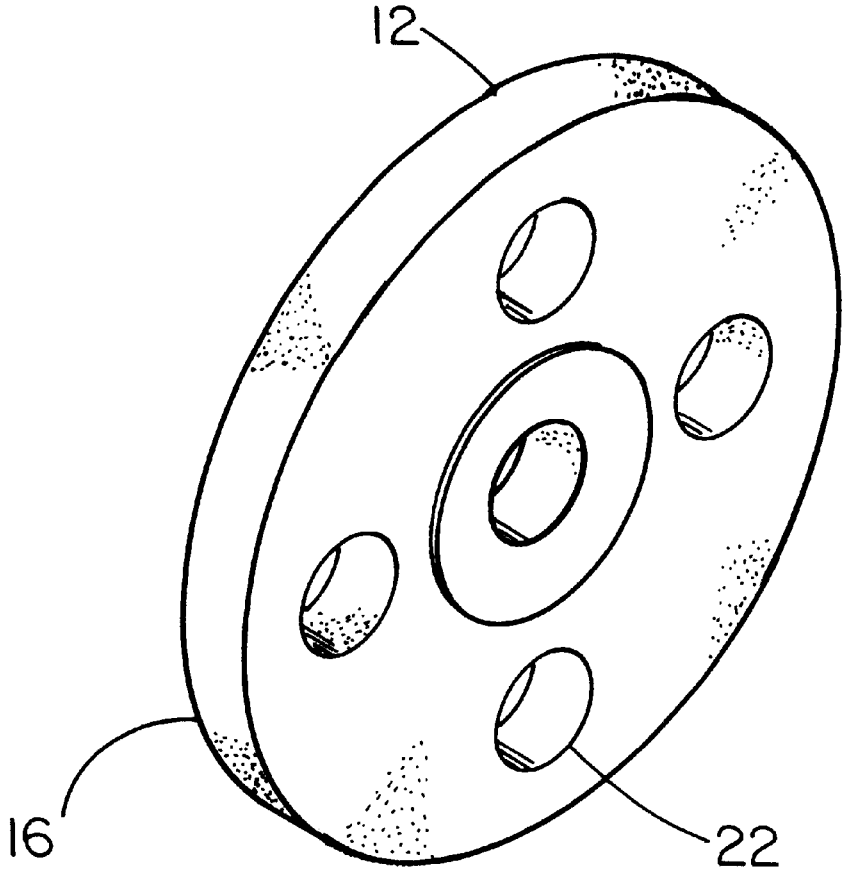
FIG. 3 is a schematic perspective view of the second embodiment of the present invention.

With reference now to the drawings, and in particular to FIGS. 1 through 3 thereof, a new grinding wheel embodying the principles and concepts of the present invention and generally designated by the reference numeral 10 will be described.

As best illustrated in FIGS. 1 through 3, the grinding wheel 10 generally comprises a grinding wheel 12. The grinding wheel 12 has a pair of sides 14 and a peripheral edge 16. The grinding, wheel 12 has an axis having a hole 18 therein. The hole 18 has a diameter preferably equal to 1¼ inches. The peripheral edge 16 has a plurality of slots 20 therein extending toward a center of the grinding wheel 12. Each of the slots 20 is equally spaced from each other. Each of the slots 20 generally has a rectangular shape, though any shape may be used, such as a triangular. The slots 20 preferably have a depth between 1 and 2 inches and a width, at the peripheral edge 16, between ½ and ¾ inches. The plurality of slots 20 is four slots, however any number greater than 1 may be uscd. The grinding wheel 12 is a conventional grinding wheel preferably comprised of an aluminum oxide abrasive material. A binding agent binds the aluminum oxide together. The height of the peripheral edge 16 is preferably between 1¼ inch and 1¾ inch.

The second embodiment is shown in FIG. 3. Openings 22 extend through the sides of the grinding wheel 12. The openings 22 are positioned a distance equal from each and equal from the peripheral edge 16 to keep the weight balanced.

In use, the grinding wheel would be used as a conventional grinding wheel. The hole being in position to receive an arbor for mounting on. When grinding, the slots and openings, which may be used together, allow the user to see what they are grinding. The spinning of the grinding wheel causes the slots an openings to become a window for seeing through the grinding wheel. The grinding wheel is rotating sufficiently fast to allow the slots to unnoticeably move past the object being ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing, is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A grinding wheel device, said device comprising:

a grinding wheel having a peripheral edge, said grinding wheel having a center, a plurality of slots in communication with and extending from said peripheral edge toward the center of said grinding wheel, each of said slots being equally spaced from each other, each of said slots being defined by a pair of side edges extending inwardly from said peripheral edge to an inner edge, the side edges of each said slot being oriented substantially parallel to each other between said peripheral edge and said inner edge;

wherein said inner edge of each said slot is oriented substantially perpendicularly to said each of said side edges of said slot; and wherein said grinding wheel has a central hole defined by a central edge, said inner edge of each said slot being located substantially midway between said peripheral edge and said central hole.

2. The grinding wheel device as in claim 1, wherein said plurality of slots comprises four slots.

3. The grinding wheel device as in claim 1, wherein each said side edge of each said slot is oriented substantially perpendicular to a tangent to said peripheral edge.

4. A grinding wheel, said device comprising:

a grinding wheel having a pair of sides and a peripheral edge, said grinding wheel having a center with a central hole, said central hole having a diameter generally equal to 1¼ inches, a plurality of slots in communication with and extending from said peripheral edge toward the center of said grinding wheel, each of said slots being equally spaced from each other, each of said slots being defined by a pair of side edges extending inwardly from said peripheral edge to an inner edge, the side edges of each said slot being oriented substantially parallel to each other between said peripheral edge and said inner edge, said plurality of slots being four slots, said grinding wheel comprising aluminum oxide abrasive material, a binding agent binding said aluminum oxide together;

wherein each said side edge of each said slot is oriented substantially perpendicular to a tangent to said peripheral edge, wherein said inner edge of each said slot is oriented substantially perpendicularly to said each of said side edges of said slot;

wherein said grinding wheel has a central hole defined by a central edge, said inner edge of each said slot being located substantially midway between said peripheral edge and said central hole.

* * * * *